United States Patent [19]

Sanchez

[11] 4,142,814

[45] Mar. 6, 1979

[54] PARKING AREA DIVIDER

[76] Inventor: Richard E. Sanchez, 8548 Manatee St., Downey, Calif. 90240

[21] Appl. No.: 807,582

[22] Filed: Jun. 17, 1977

[51] Int. Cl.[2] ..... E01C 11/22

[52] U.S. Cl. ..... 404/7; 256/1

[58] Field of Search ..... 404/6, 7, 8, 9, 10; 256/1, 13.1, DIG. 2; 52/309.4, 309.17

[56] References Cited

U.S. PATENT DOCUMENTS

| | | | |
|---|---|---|---|
| 3,698,290 | 10/1972 | Wallace | 404/7 |
| 3,762,113 | 10/1973 | O'Mullan et al. | 404/7 |
| 3,951,384 | 4/1976 | Hildreth | 404/9 |
| 3,963,218 | 6/1976 | Glaesener | 404/6 |
| 4,035,059 | 7/1977 | DeMaster | 404/06 |

FOREIGN PATENT DOCUMENTS

| | | | |
|---|---|---|---|
| 1658470 | 10/1970 | Fed. Rep. of Germany | 404/7 |
| 2296053 | 7/1976 | France | 404/7 |

*Primary Examiner*—Henry Jaudon

[57] ABSTRACT

A parking lot space marker or "bumper" is provided having a plastic foam body enclosed by a smooth surfaced cover. Alternatively, bandlike clamps or adhesive can be used to secure the marker to the parking lot surface.

4 Claims, 6 Drawing Figures

FIG. 1.
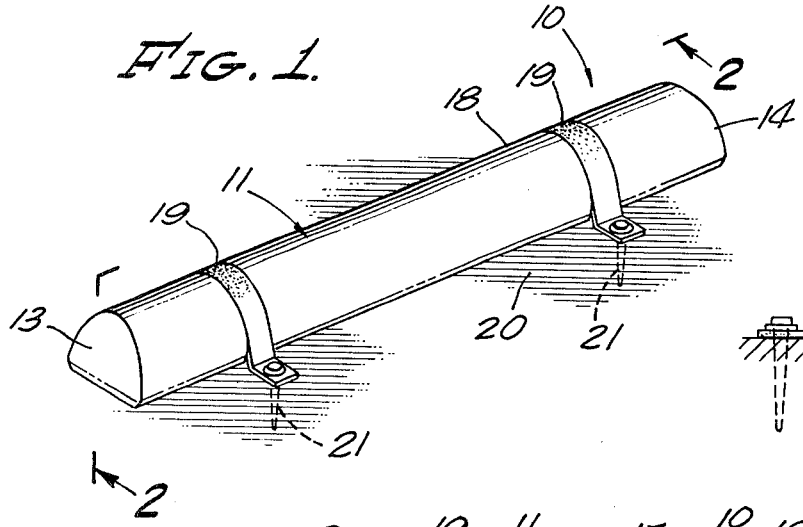
FIG. 6.
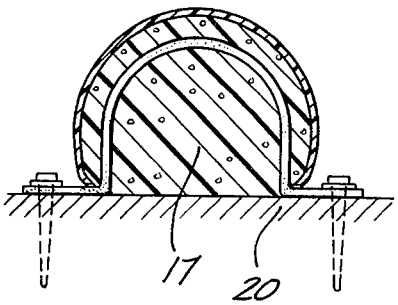
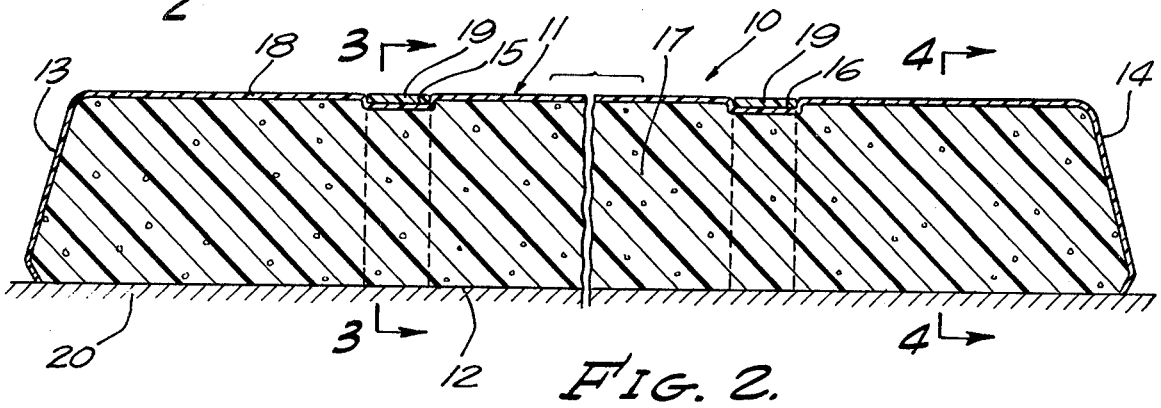
FIG. 2.
FIG. 3.
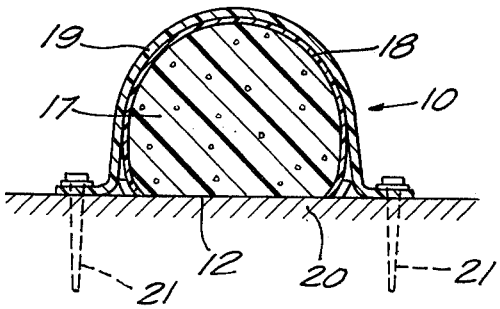
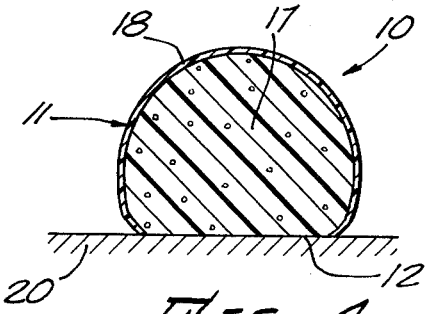
FIG. 4.
FIG. 5.
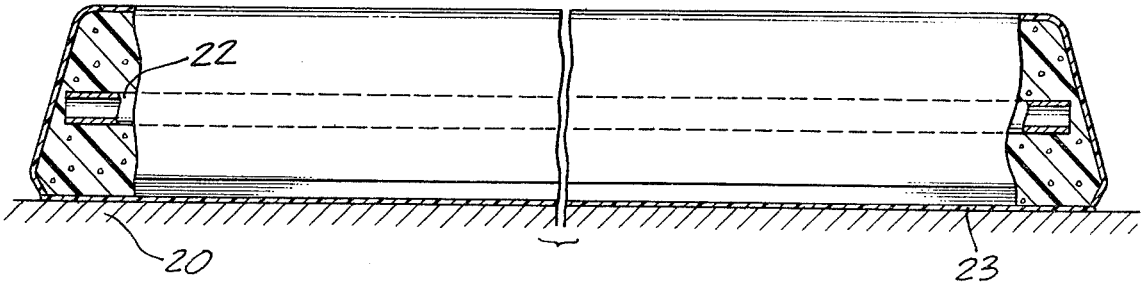

PARKING AREA DIVIDER

The present invention relates generally to a parking space marker, and, more particularly, to such a marker for defining the limits of parking areas for automobiles.

BACKGROUND OF THE INVENTION

Automobile parking areas, or lots, more conventionally are laid out such that parked cars are uniformly spaced from one another laterally, and means are provided to define the forward limit of parking for each auto in its associated space.

One approach in the past has been to paint lines of demarcation on the parking lot surface, indicating the exact areas within which each auto should park. The disadvantages of this technique are at least the following: (1) The markings do not prevent a driver from parking outwardly of a predetermined zone or in more than one zone. (2) The painted lines are sometimes difficult to see, especially at night. (3) Painted lines become smudged and difficult to see in time, merely as a result of autos constantly crossing them.

A further common known technique has been to provide concrete abutments defining the parking area for each auto. In a still further form, a concrete abutment is used to limit the forward extent of the parking space while painted lines define the lateral extents.

Although concrete abutments are advantageous over mere painted lines, they have certain clear disadvantages. First of all, in use they tend to break and chip away as a result of striking with the automobile tires. Also, they are very heavy and for that reason are relatively expensive to install and replace, requiring either complex forms for on-site fabrication or additional labor in loading and unloading the heavy items when fabricated remotely from the use location.

DESCRIPTION OF THE DRAWING

FIG. 1 is a perspective view of the parking space marker of this invention.

FIG. 2 is a sectional, elevational view taken along line 2—2 of FIG. 1.

FIG. 3 is a sectional, elevational view taken along line 3—3 of FIG. 2 through a securing strap.

FIG. 4 is a further sectional, elevational view taken along line 4—4 of FIG. 2 through a part lying outwardly of a securing strap.

FIG. 5 is a side elevational, partially fragmentary view of an alternate form of the invention.

FIG. 6 is a sectional view showing an alternative clamping arrangement.

DESCRIPTION OF PREFERRED EMBODIMENTS

With reference now to the drawing, and particularly FIGS. 1-3, the parking space marker or divider of this invention is enumerated generally as at 10. It is seen to include an elongated body member 11 having at least one flat surface 12 extending the full length of the body. The peripheral surface is preferably curved so that in the sectional views of FIGS. 3 and 4, the body is seen to be circular except for that part removed to form the flat surface 12. The ends 13 and 14 are tapered back from the flat surface and all edges are rounded to remove any sharpness. A pair of bandlike, circumferentially extending slots 15 and 16 are provided at a convenient spacing from the body ends.

In construction, the body 11 has a core 17, molded from a polyurethane foam. The core is then jacketed with an A. B. S. (acrylonitrile-butadiene-styrene) covering 18 that by known heat treating techniques will "shrink" tightly onto the foam core. The covering does not extend over the flat surface 12 (FIG. 3), but leaves it free for a purpose to be described.

On installation, properly sized, preformed nylon straps 19 are received in the bandlike grooves 15 and 16 and secured to the parking area surface 20 by spikes 21, for example. On cement or madacam surfaces 20, the spikes or studs may be either manually implanted or by the use of a high-pressure gun. The length of the spikes required depends primarily on the thickness of the concrete or other composition surface 20.

Reference is now made to FIG. 5, where an alternative version is depicted. The construction is the same as already described in connection with the FIG. 1 embodiment, except that a rigid tubular element 22 of substantially the same length as the body 11 is axially located in the foam. The addition of element 22 considerably strengthens the construction, especially against transverse beam deflections.

It is also to be noted that there are no bandlike slots or straps used in the FIG. 5 version. Instead, an adhesive 23 is provided adheringly securing the flat surface 12 to the parking lot surface.

It is also contemplated that the reinforcing element 22 could be added to the foam core of the embodiment shown in FIGS. 1-4. Moreover, the FIG. 5 version may be found fully satisfactory in some circumstances without the tube reinforcing element.

In a still further respect, the foam body 17 may be constructed of certain polyurethane foams that have the additional property of forming a smooth outer skin or covering on setting up. Formation of this "self-skin" obviates the necessity of providing a separate cover such as the cover 18. Otherwise, construction and installation are the same as in the first two described embodiments.

Although other materials may be found satisfactory, a plastic foam having a "self-skin" which is excellent for use herein is a microcellular urethane elastomer sold under the trade style "Bayflex" by Mobay Chemical Corporation, Pittsburgh, Pennsylvanis, is excellent for this purpose.

In a still further aspect shown in FIG. 6, the straps can be molded into the body of the foam core at the time the core is molded, spaced substantially inwardly of the outer surface. In this case the grooves 15 and 16 are not needed.

In the practice of this invention, there is provided a parking lot divider or marker that is durable, lightweight, easy to install, and relatively inexpensive to manufacture. The divider is especially useful as a parking "bumper" for defining the forward limit of travel in a parking space. Also, it is contemplated that an item of very similar shape to the divider 10 could be used as a so-called "speed bump", which may be located in roads or parking areas to deter speeding.

I claim:

1. A parking lot surface space marker, comprising:

an elongated foam core having at least one longitudinally extending flat surface;

a plastic cover received over said core conforming to the core periphery except for said core flat surface;

strap means received transversely about said core and cover for securing the core flat surface against said parking lot surface; and a reinforcing rodlike member received in said core extending longitudinally thereof.

2. A space marker as in claim 1, in which the reinforcing rodlike member is a cylindrical tube.

3. A divider for use in defining areas on a groundplane surface within which to park automobiles, comprising:

a foam body;

a plastic cover enclosing said foam body;

strap means received within said foam body having end portions extending outwardly therefrom; and means for affixing the strap means to the surface.

4. A divider as in claim 3, in which the foam body is constructed of a material that sets up to provide a foam core having a peripheral skinlike covering.

* * * * *